United States Patent [19]

White et al.

[11] 4,364,562

[45] Dec. 21, 1982

[54] BASEBALL REBOUND TARGET

[76] Inventors: John M. White, 25 Vernon St., Hyde Park, Mass. 02136; George Owen, Jr., 23 Robbins St., Milton, Mass. 02186

[21] Appl. No.: 141,049

[22] Filed: Apr. 17, 1980

[51] Int. Cl.[3] ..... A63B 69/40

[52] U.S. Cl. ..... 273/26 A; 273/407

[58] Field of Search ..... 273/407, 408, 410, 317, 273/344, 345, 348, 369, 393, 30, 26 A, 390; 248/464, 413, 441 R, 465, 163

[56] References Cited

U.S. PATENT DOCUMENTS

| | | | |
|---|---|---|---|
| 392,565 | 9/1888 | Larew | 248/464 |
| 2,162,438 | 6/1939 | Letarte | 273/26 A |
| 3,001,790 | 9/1961 | Pratt | 273/26 A |
| 3,190,649 | 6/1965 | Heisler | 273/30 |
| 3,814,422 | 6/1974 | Girden | 273/30 |
| 3,942,795 | 3/1976 | Psenka | 273/30 |
| 4,036,465 | 7/1977 | Kellner | 248/464 |
| 4,083,559 | 4/1978 | Owen, Jr. | 273/26 A |
| 4,148,555 | 4/1979 | Lerman | 273/127 C |

FOREIGN PATENT DOCUMENTS

| | | | |
|---|---|---|---|
| 707648 | 4/1965 | Canada | 273/127 R |
| 1223579 | 2/1971 | United Kingdom | 273/127 B |

*Primary Examiner*—Richard C. Pinkham

*Assistant Examiner*—T. Brown

*Attorney, Agent, or Firm*—Cooper, Dunham, Clark, Griffin & Moran

[57] ABSTRACT

The present invention provides a device for training baseball players, particularly baseball pitchers, which employs a laminated, impact-resistant target board which is rigidly attached to a frame structure. The position of the target board relative to a person or player throwing baseballs at the target is such that the balls which strike the target are reflected and return back to the thrower. More particularly, the apparatus of this invention comprises a frame which includes a top cross-bar to which supporting legs are movably attached, horizontal cross-bars attached to the front legs and a laminated, impact-resistant target board which is of substantially the same length and width as a normal baseball strike zone and which is attached to the horizontal cross-bars at a location corresponding to the location of the normal strike zone of a baseball batter. The apparatus preferably includes a net attached to the frame structure in such a way that thrown balls which miss the target board are caught in the net and may be easily retrieved. By repeated throwing practice using the apparatus of this invention, a person can significantly improve throwing accuracy.

9 Claims, 3 Drawing Figures

BASEBALL REBOUND TARGET

BACKGROUND OF THE INVENTION

It is well known that the accuracy of throwing a baseball or other ball, can be improved by repeated throwing practice. This is particularly true for baseball pitchers for whom the ability to consistently throw a baseball a fixed distance and deliver the baseball within the strike zone of an opposing batter is of crucial importance. Numerous devices have been previously proposed for use in practicing the throwing of a ball so as to improve throwing accuracy. Merely by way of example, one such device is disclosed in U.S. Pat. No. 4,083,559. All of the previous devices, however, are associated with certain disadvantages. Thus, for example, with certain devices it may repeatedly be necessary that the thrower cease practicing and retrieve previously thrown balls before being able to continue practicing. In other devices, the target surface may not be sufficiently durable to withstand the repeated high impact forces generated by thrown baseballs which may be moving at velocities approaching 100 miles per hour at the time of target impact. Finally, certain devices may not be adaptable for use by persons of different ages and sizes.

In accordance with the present invention, these various disadvantages have been overcome by a device which includes a laminated, impact-resistant target board capable of withstanding the repeated impact force of thrown baseballs. In addition, the device of this invention is so designed that thrown baseballs which strike the target board are reflected and returned back to the thrower, thereby reducing the number of times it is necessary to discontinue practicing and recover balls which have been thrown. Finally, the instant device is readily adapted for use by persons of different ages and sizes.

SUMMARY OF THE INVENTION

The present invention provides a baseball rebound device which comprises a frame structure including a top cross-bar to which are attached at either end supporting legs forming inverted V's. The legs are movable about the top cross-bar. A plurality of horizontal cross-bars are attached to the front supporting legs and a laminated target board having high impact-resistance and having substantially the same length and width as a normal baseball strike zone is attached to the horizontal cross-bars at a location which corresponds to the location of the normal strike zone of an opposing baseball batter. Preferably, the device also includes a net attached to the frame structure in such a manner that thrown balls which miss the target board are caught therein.

DETAILED DESCRIPTION OF THE INVENTION

The baseball rebound target device of the present invention may be constructed of any suitable material such as metals including aluminum or stainless steel or non-metals such as plastics or fiberglass. Accordingly, the description which follows does not make reference to specific materials of construction except in those instances where the use of specific materials constitutes a portion of the present invention.

Figure 1:
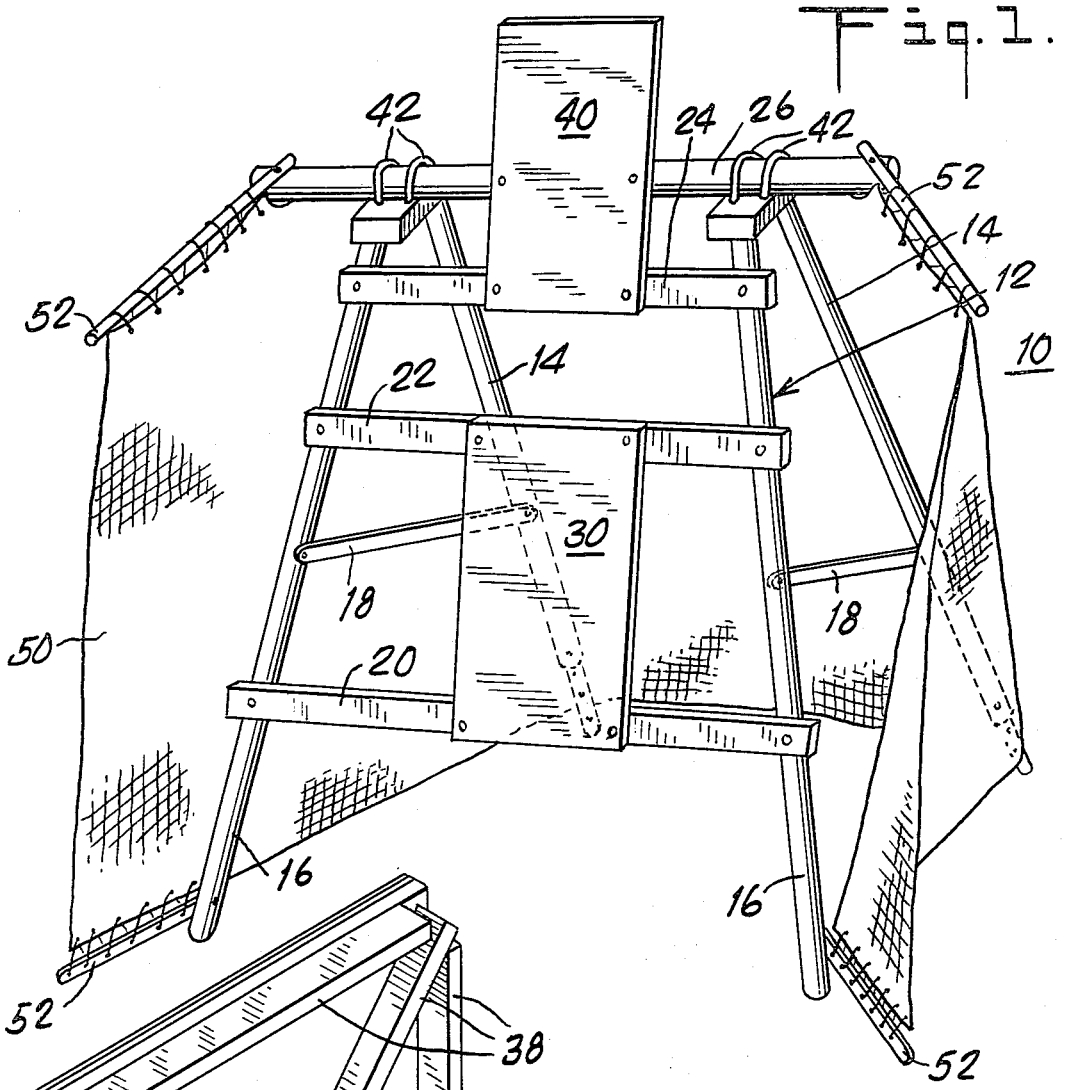
FIG. 1 is a perspective view of a baseball rebound target device in accordance with the present invention.

As shown in FIG. 1, the baseball rebound target device of the present invention 10 comprises a frame 12 capable of freely standing on any substantially flat surface such as the surface of a baseball playing or practice field. Frame 12 includes rear legs 14 and front legs 16 attached to top cross-bar 26, each pair of rear and front supporting legs forming an inverted V. The inverted V leg configuration so formed is attached to top cross-bar 26 by means of a suitable attachment means 42 which permits movement of the legs in a plane substantially perpendicular to the plane of top cross-bar 26. When erect and in use, each rear leg 14 and front leg 16 are preferably held in fixed position with respect to one another by means of leg brace 18 which may be of adjustable length. Upon detachment of leg braces 18 from the legs, the device may be collapsed for ease in transporting the device to another location. The baseball rebound device of the present invention is further provided with a plurality of horizontal cross-bars securely attached to the front legs 16 of frame structure 12. In the embodiment of the invention illustrated in FIG. 1, the device is provided with a bottom cross-bar 20, a lower middle cross-bar 22, and an upper middle cross-bar 24 in addition to the top cross-bar 26. As further shown in FIG. 1, the laminated, impact-resistant pitching target board 30, which is of substantially rectangular shape and has the length and width of a normal strike zone of an average opposing batter, is rigidly attached to the horizontal cross-bars at a location which corresponds to the location of the normal strike zone of a baseball batter of average height. Typically, the length of target board 30 will be in the range from about 30 to about 50 inches, e.g., about 40 inches, and the width of target board 30 will be about 17 inches. Moreover, the target board will be located from about 15 to about 25 inches above the ground or other surface on which the frame stands, e.g., about 20 inches.

If desired, a second, laminated, impact-resistant target board 40 of substantially the same dimensions can be attached to the upper portion of the frame for use in practicing types of throwing other than pitching, particularly the type of throwing performed by a baseball catcher attempting to throw a baseball to second base from home plate on a normal baseball diamond. Such a second target board will typically be rigidly attached to the upper portion of frame 12 at a loction extending upwards from a location from about 65 to about 75 inches above the ground or other surface on which the frame stands.

Desirably, the baseball rebound device is also provided with a net 50 attached to frame 12 by suitable attachment means such as brackets 52. During throwing practice utilizing the device, net 50 serves to capture thrown balls which miss pitching target 30 and makes ball retrieval easier.

Figure 2:
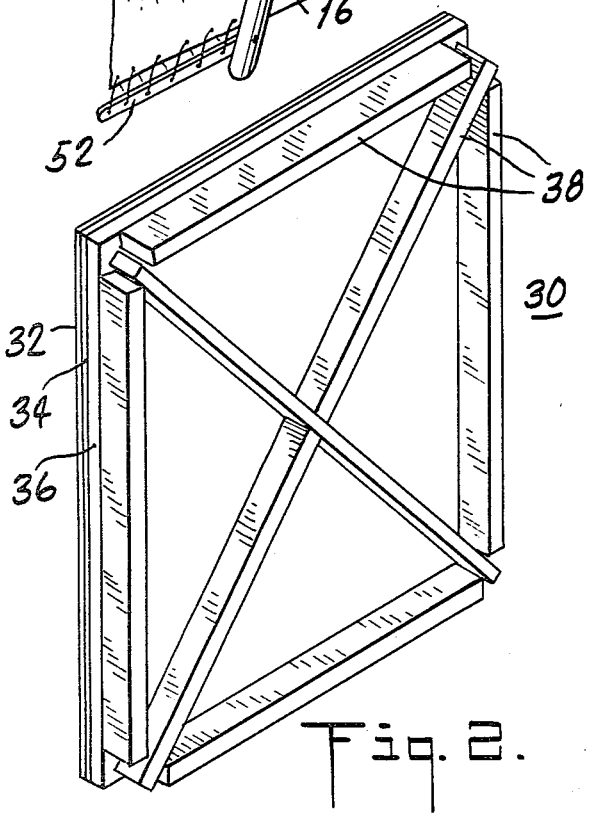
FIG. 2 is a side perspective view of a laminated, impact-resistant target board according to the invention.

As shown more clearly in FIG. 2, pitching target board 30 is comprised of a plurality of layers of a material having high impact-resistance. It is presently preferred that target board 30 comprise an outer sheet 32 of about ½ inch Masonite. (Masonite is the trademark of the Masonite Corporation for a composition hardboard made by treating wood chips with steam at high pressure and compressing the resulting fibers into mats from which rigid panels are made by hot-pressing. The fiber is usually then water-proofed with an emulsion having a paraffin base.) In the presently preferred embodiment of the present invention, the target board further includes a second inner sheet 34 of ¼ inch Masonite. Both the outer Masonite sheet 32 and the inner Masonite sheet 34 are placed over a ¾ inch plywood backing sheet 36. The various sheets are then rigidly attached to a suitable brace structure 38, for example, by means of bolts so as to form the entire laminated impact-resistant target board 30.

The pitching rebound device of the present invention can be used to practice throwing and to improve throwing accuracy at various distances. By varying the angle between back legs 14 and front legs 16, the angle of pitching target board 30 with respect to a vertical plane relative to the ground or other surface on which the frame stands can be varied so that the appropriate angle is established to permit rebounding return of thrown baseballs which strike the target after having been thrown at the target from various distances.

Figure 3:
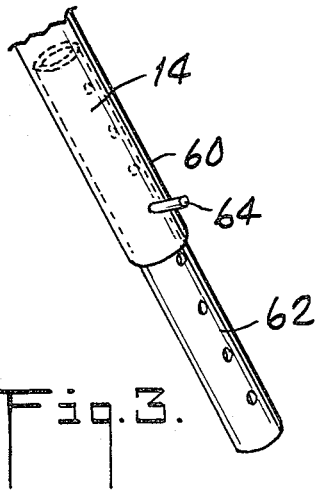
FIG. 3 is a perspective view of a telescoping rear supporting leg of a frame structure according to the invention.

Alternatively, the angle of pitching target board 30 with respect to the ground can be varied by varying the length of rear legs 14. As shown in FIG. 3, rear legs 14 therefore preferably include a hollow upper cylindrical portion 60 and a lower cylindrical portion 62 which may be hollow or solid such that the inner diameter of cylindrical portion 60 is greater than the outer diameter of cylindrical portion 62. In combination, upper portion 60 and lower portion 62 function as a leg of telescopingly variable length. Desired lengths to achieve pitching board angles can be obtained by a suitable fastening member such as peg 64 inserted into holes disposed along lower leg portion 62.

As will be obvious to one skilled in the art, many modifications, variations and alterations can be made in the pitching rebound device of the present invention without departing from the spirit and scope thereof as set forth in the claims which follow.

What is claimed is:

1. A baseball rebound device useful in improving throwing accuracy which comprises:

a frame structure including a top cross-bar;

a pair of legs movably attached substantially at each end of said cross-bar, each pair of said legs forming an inverted v; a pair of front legs defined by one leg of each said pair of legs and a pair of rear legs defined by the other leg of each said pair of legs, said front and rear legs being adjustable relative to each other, a plurality of horizontal cross-bars rigidly attached to the front legs; and a laminated, impact-resistant planar target board having substantially the same length and width as a normal baseball strike zone rigidly attached to the horizontal cross-bars at a location which corresponds to the location of a normal strike zone of an opposing baseball batter.

2. A baseball rebound device in accordance with claim 1 wherein the laminated, impact-resistant planar target board comprises a plurality of Masonite sheets.

3. A baseball rebound device in accordance with claim 2 wherein the laminated, impact-resistant planar target board comprises an outer sheet of Masonite, an inner sheet of Masonite and a plywood backing sheet.

4. A baseball rebound device in accordance with claim 1 which additionally comprises a leg brace attached to each pair of rear and front legs to hold the legs in fixed position with respect to one another.

5. A baseball rebound device in accordance with claim 1 which additionally comprises a net attached to the frame structure in such a manner that thrown balls which miss the target board are caught therein.

6. A baseball rebound device in accordance with claim 1 wherein the rear legs are of variably adjustable length.

7. A baseball rebound device in accordance with claim 1 which additionally comprises a second laminated, planar impact-resistant planar target board fixedly attached to the upper portion of the frame structure.

8. A baseball rebound device in accordance with claim 1 wherein the laminated, impact-resistant planar target board is capable of withstanding the impact force of thrown baseballs traveling at speeds of about 100 miles per hour.

9. A baseball rebound device useful in improving throwing accuracy which comprises:

a frame structure including a top cross-bar;

a pair of legs movably attached substantially at each end of said cross-bar, each pair of said legs forming an inverted v; a pair of front legs defined by one leg of each said pair of legs and a pair of rear legs defined by the other leg of each said pair of legs, said front and rear legs being adjustable relative to each other, a plurality of horizontal cross-bars rigidly attached to the front legs; and a laminated, impact-resistant planar target board having substantially the same length and width as a normal baseball strike zone rigidly attached to the horizontal cross-bars at a location which corresponds to the location of a normal strike zone of an opposing baseball batter, said target board comprising a plurality of Masonite sheets.

* * * * *